United States Patent [19]

Growney

[11] Patent Number: 4,477,016

[45] Date of Patent: Oct. 16, 1984

[54] CELLULAR DISPLAY STRUCTURE

[75] Inventor: Lawrence J. Growney, Pearl River, N.Y.

[73] Assignee: Federal Paper Board Company, Inc., Montvale, N.J.

[21] Appl. No.: 361,981

[22] Filed: Mar. 25, 1982

[51] Int. Cl.[3] ..... B65D 5/48

[52] U.S. Cl. ..... 229/28 R; 206/44 R; 206/45.11; 206/175; 206/193; 229/28 BC; 211/73

[58] Field of Search ..... 229/28 R, 28 BC, 28 D, 229/52 BC, 27, DIG. 3; 206/160, 174, 175, 176, 177, 193, 196, 197, 200, 45.11, 429, 44, 45; 298/174; 211/73; 29/6.1, 6.2

[56] References Cited

U.S. PATENT DOCUMENTS

| | | | |
|---|---|---|---|
| 1,002,633 | 9/1911 | Boos | 211/73 |
| 1,086,027 | 2/1914 | Clark | 29/6.1 X |
| 1,208,241 | 12/1916 | Varley | 29/6.1 X |
| 1,959,619 | 5/1934 | Ebert | 229/28 R |
| 2,319,225 | 5/1943 | Grebe et al. | 229/DIG. 3 |
| 2,458,281 | 1/1949 | Lupton | 229/28 BC |
| 2,535,741 | 12/1950 | Lighter | 229/52 BC |
| 2,545,589 | 3/1951 | Samsing | 229/28 BC |
| 2,551,559 | 5/1951 | Gilbert | 229/28 R |
| 2,598,920 | 6/1952 | Keith | 229/28 R |
| 2,660,361 | 11/1953 | Tyrsech | 229/28 R |
| 2,709,535 | 5/1955 | Bergstein | 229/28 BC |
| 3,784,053 | 1/1974 | Stout | 229/28 BC |
| 3,789,476 | 2/1974 | Ripley | 29/6.1 X |
| 4,099,309 | 7/1978 | Bender | 29/6.1 X |
| 4,291,443 | 9/1981 | Laurre | 29/6.1 |
| 4,311,269 | 1/1982 | Montealegre | 229/28 R |
| 4,313,554 | 2/1982 | Montealegre | 229/28 R |

*Primary Examiner*—William T. Dixson, Jr.
*Assistant Examiner*—Bryon Gehman
*Attorney, Agent, or Firm*—Charles A. Brown

[57] ABSTRACT

This relates to a display carton which is divided into a plurality of cells by way of a cellular separator arrangement. The cellular separator arrangement includes front to rear extending partition members and transversely extending transverse separators. All are cut from a single blank panel and are integrally hinged to one another an associated side, front and rear panels. In the blank there is cut from a single panel carton components in the form of a front panel, a side panel, a rear panel portion a side panel portion, the partition members and the transverse separators.

17 Claims, 9 Drawing Figures

FIG.3
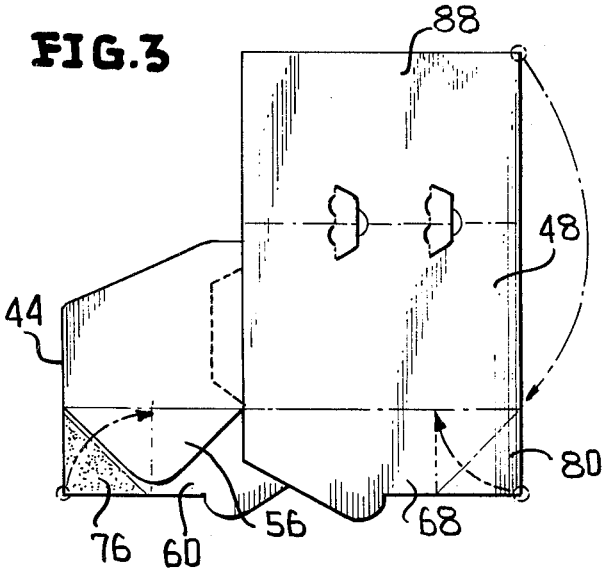
FIG.4
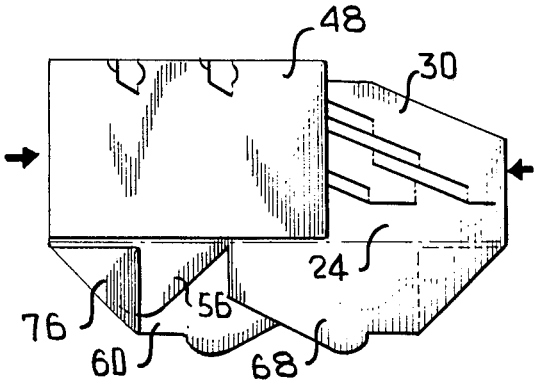
FIG.5
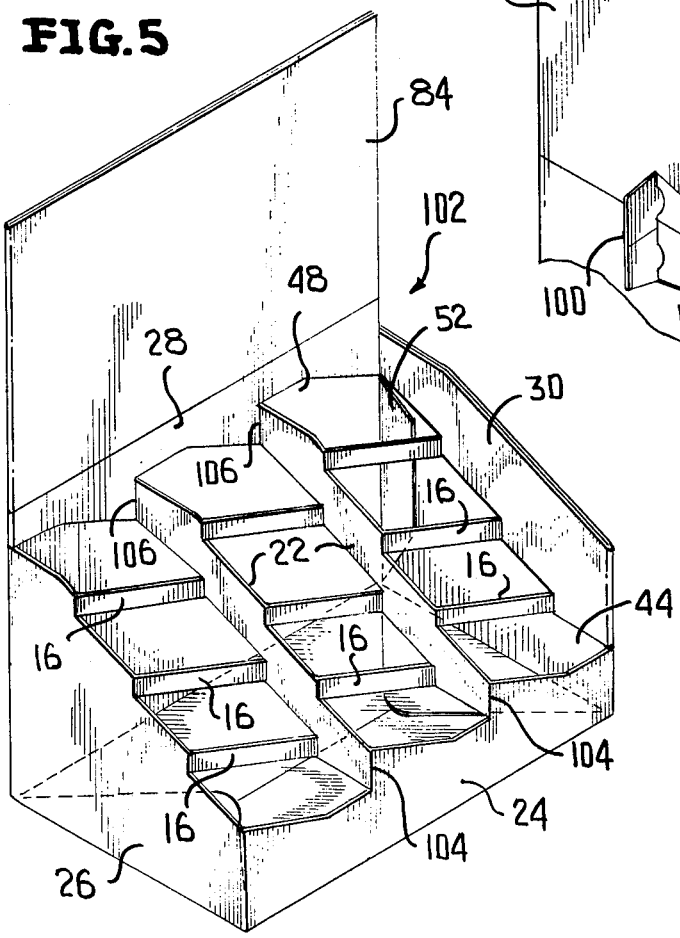
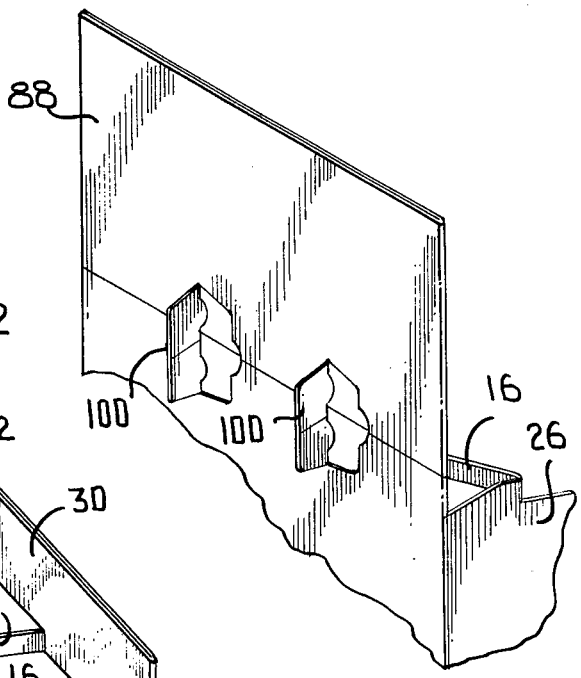
FIG.6

CELLULAR DISPLAY STRUCTURE

This invention relates in general to new and useful improvements in display type cartons, and more particularly to a display type carton wherein the carton includes an upper one-piece cellular separator arrangement which generally overlies the bottom wall of the carton and permits the individual display of a plurality of individual packages or containers.

This invention particularly relates to in a display carton a one-piece cellular separator arrangement which includes front to rear sloping partition members and transverse separators extending between side panels and adjacent partition members.

Another feature of the invention is that the transverse separators of each row are in a stepped arrangement with each one as a higher elevation as they progress rearwardly so that each and every one of the transverse separators becomes visible.

Another feature of the invention is the fact that a front panel, a rear panel portion, a side panel, a side panel portion, the desired number of partition members, and the necessary transverse separators may all be formed from a single panel by way of a plurality of cut lines and fold lines without there being any waste and wherein all of the panels, partition members and transverse separators may be readily folded out of the single planar panel to a three dimensional configuration.

Another feature of the invention is the provision in the display carton of a further side panel which backs up the side panel portion and a further rear panel which backs up the rear panel portion, and wherein the two side panels, the front panel and the rear panel each carry a bottom panel, the bottom panels cooperating with one another to form a carton bottom which is readily foldable in the same general plane as the panels from which the cellular separator arrangement is formed so that the display carton may be readily set up.

Finally, and most particularly, there is provided a blank which includes a single panel from which the cellular separator arrangement is formed by a plurality of straight line cuts and cooperating folds.

With the above and other objects in view that will hereinafter appear, the nature of the invention will be more clearly understood by reference to the following detailed description, the appended claims, and the several views illustrated in the accompanying drawings.

FIG. 3 is a plan view similar to FIG. 2 and shows the blank in a further folded state wherein remote end portions of the blank have been connected together.

FIG. 4 is yet another plan view of the blank in its finally folded and joined together state.

FIG. 5 is a front perspective view of the display carton in its erected condition.

FIG. 6 is a fragmentary rear elevational view of the display carton and shows the manner in which an upper display portion thereof is held in an erected position.

Figure 1:
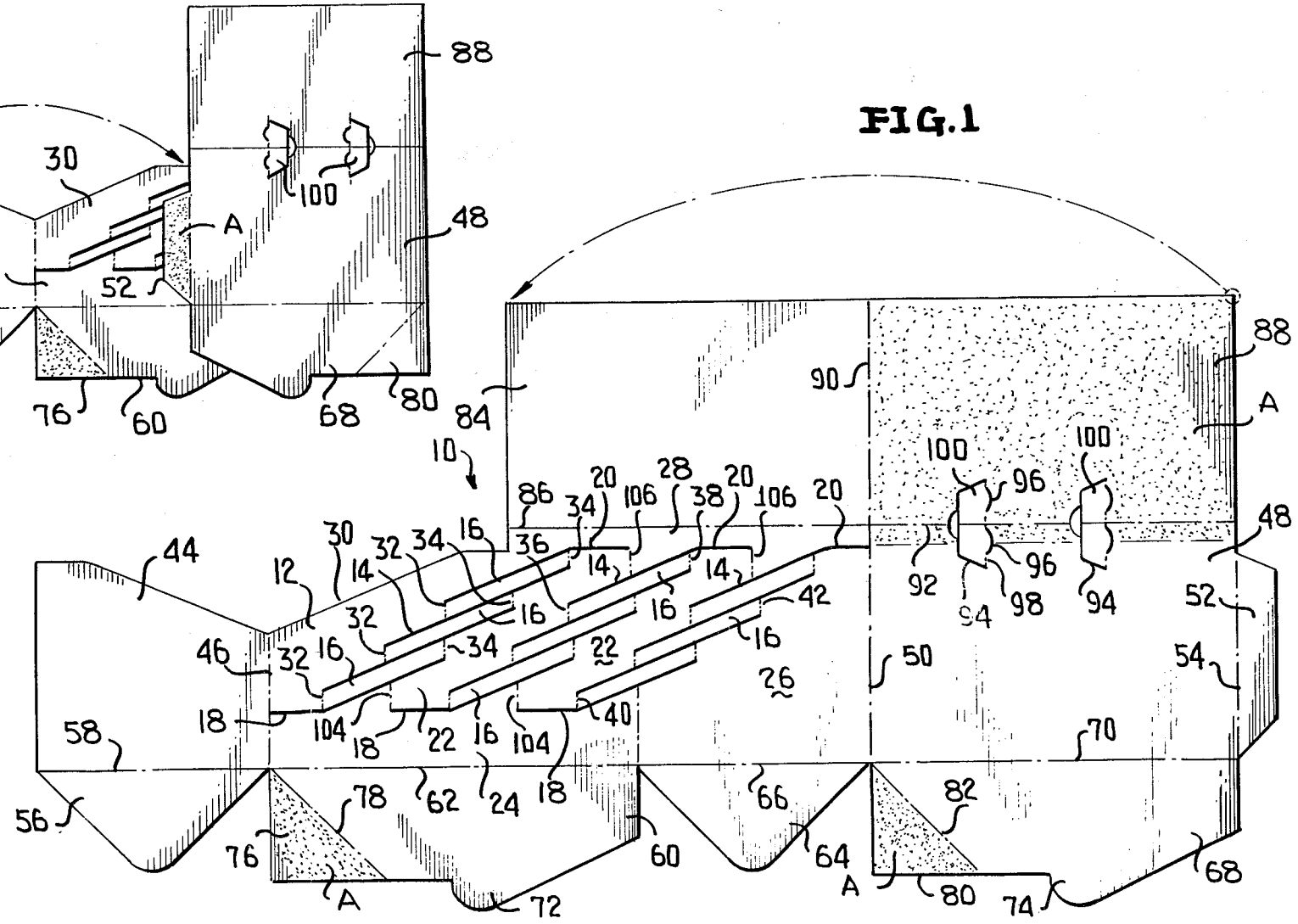
FIG. 1 is a plan view of the rear surface of a blank from which the display carton is formed.

Referring now to the drawings in detail, reference is first made to FIG. 1 wherein there is illustrated a blank from which the display carton is formed, the blank being generally identified by the numeral 10. The blank 10, which is preferably formed of paperboard, includes an elongated, generally rectangular, central panel 12. The panel 12 is provided with sets of parallel cut lines 14 which slope up and to the right. In the illustrated embodiment of the invention, there are three sets of the cut lines 14 although the number of sets of cut lines 14 may vary as desired.

The sloping cut lines of each set of cut lines 14, in the illustrated embodiment of the invention, define three transverse separators 16 which are arranged in partially overlapping relation.

The sloping cut lines 14 in association with lower horizontal cut lines 18 and upper horizontal cut lines 20 define between the three sets of cut lines 14 two partition members 22. The cut lines 14, 18 and 20 also define a front panel 24, a side panel 26, a rear panel portion 28 and a side panel portion 30. The transverse separators of the left hand set of such separators are connected to the side panel portion 30 at their lower ends along fold lines 32 and at their upper ends to the adjacent partition member 22 along fold lines 34.

The intermediate transverse separators 16 are connected at their opposite ends to the partition members 22 along fold lines 36 at their lower ends and fold lines 38 at their upper ends.

The right hand set of transverse separators 16 are connected at their lower ends to the adjacent partition member 22 along fold lines 40 and at their upper ends to the side panel 26 along fold lines 42.

The blank 10 also includes a second side panel 44 which is connected to the left edge of the panel 12 along a fold line 46, which fold line 46 connects the second side panel 44 for relative folding movement to both the front panel 24 and the side panel portion 30.

At the opposite end of the panel 12 there is connected a rear panel 48 along a fold line 50, the fold line 50 being at the edges of both the side panel 26 and the rear panel portion 28. The end of the rear panel 48 remote from the panel 12 is provided with a connecting flap 52 which is connected to the panel 48 along a fold line 54.

The blank 10 also includes bottom forming panels. The bottom forming panels include a triangular panel 56 which is connected to the second side panel 44 along a fold line 58. Another bottom forming panel 60, which is generally rectangular in outline, is connected to the front panel 24 along a fold line 62. A second triangular bottom panel 64 is connected to the side panel 26 along a fold line 66. Finally, a second elongated bottom panel 68 is connected to the rear panel 48 along a fold line 70. The fold lines 58, 62, 66 and 70 are all in alignment and are continuations of one another.

It is also to be noted that the bottom panels 60 and 68 are provided with projecting interlocking flaps 72 and 74. Further, the panel 60 is provided with a foldable triangular corner portion 76 which is defined by a fold line 78. The bottom panel 68 is provided with a similar foldable triangular corner portion 80 which is defined by a diagonal fold line 82.

In the event the display carton is to have an upper rear display area, the blank 10 also includes a generally rectangular front display panel 84 which is connected to the rear panel portion 28 along a fold line 86. There is also a rear display panel 88 which is connected to the panel 84 along a fold line 90 and to the rear panel 48 along a fold line 92 which is a continuation of the fold line 86.

It is also to be noted that the panels 48 and 88 have cut therein cut lines 94 which cooperate with cut lines 96 and associated fold line portions 98 to define locking flaps 100 which extend across the fold line 92 for a reason to be described hereinafter.

In order that the various parts of the blank 10 may be secured together in the formation of the display carton, the rear surface of the corner panel portion 76 is coated with an adhesive A. A like adhesive is applied to the corner panel portion 80. Adhesive A is similarly applied to the rear surface of the tab or flap 52 and the entire rear surface of the panel 88 is coated with adhesive with the adhesive also extending down onto the adjoining portion of the panel 48.

Figure 2:
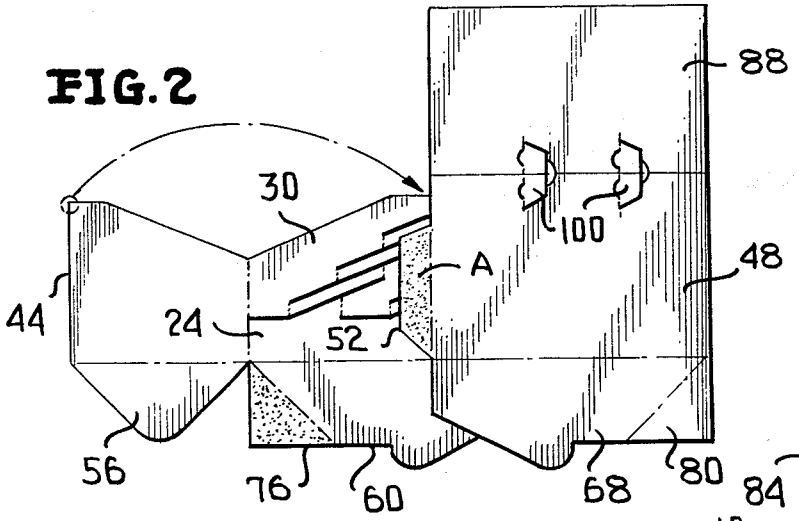
FIG. 2 is another plan view of the blank of FIG. 1 on the reduced scale with the blank being partially folded.
Figure 9:
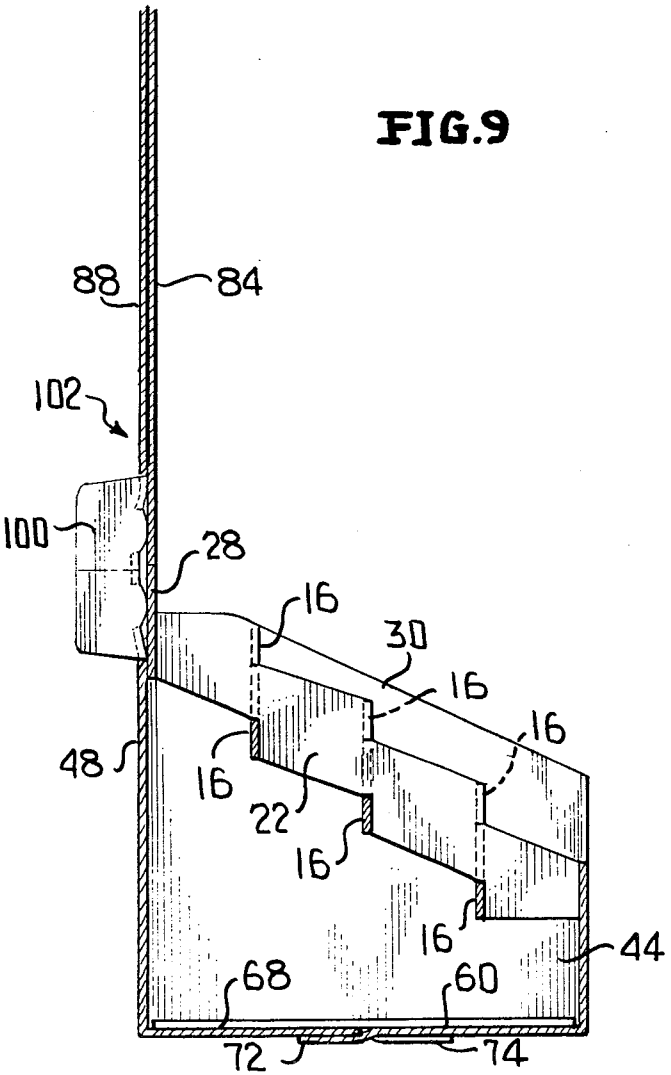
FIG. 9 is a transverse vertical sectional view taken generally along the line 9—9 of FIG. 8 and shows further the details of the cellular separator arrangement.

When the display carton, which is the subject of this invention and is identified by the numeral 102, is to be initially formed, the blank 10 is folded along the aligned fold lines 50 and 90, as shown in FIG. 2, so that the panel 88 overlies the panel 84 and is bonded thereto by the adhesive. In a like manner, that portion of the panel 48 which is provided with adhesive overlies the panel portion 28 and is adhesively bonded thereto.

Next, as is generally indicated in FIG. 2 and is specifically shown in FIG. 3, the blank 10 is folded along the fold line 46 so that the second side panel 44 is folded to a position where its free edge overlies the flap 52 and is adhesively bonded thereto.

As is next shown in FIG. 4, the triangular panel portions 76 and 80 are folded so that the panel portion 76 overlies and is adhesively bonded to the triangular bottom panel 56 and the triangular panel portion 80 underlies and is bonded to the triangular bottom panel 64. At the same time, the bonded together display panels 84 and 88 may be folded down.

Figure 7:
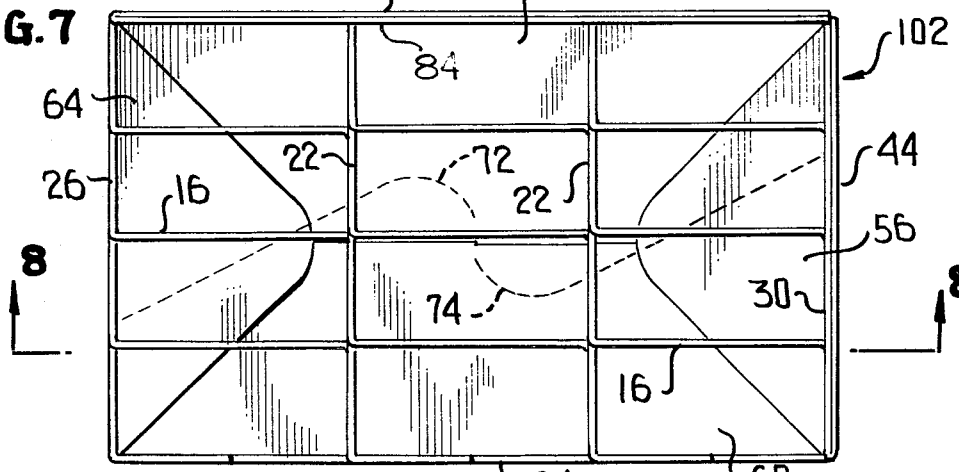
FIG. 7 is a plan view of the carton of FIG. 5 and shows the specific cellular separator arrangement.

In FIG. 4 the erected carton is illustrated as being pushed together at the remote corners and is in the process of being opened. When the display carton 102 opens, the front panel 24, the side panel 26, the rear panel portion 28 and the rear panel 48 and the side panel portion 30 and the second side panel 44 assume a rectangular configuration. The display panels 84 and 88 may be folded to upright positions and locked into place, as is shown in FIG. 6, utilizing the lock members 100. Finally, the bottom panels 56, 60, 64 and 68 may be folded into a substantially planar state with the panels overlapping as is shown in FIG. 7 to form the bottom. The carton is now complete ready to receive packages or containers and the like for display.

It will be readily apparent from the drawings that in the erected carton 102, the partition members 22 extend upwardly and rearwardly from the front panel 24 to the rear panel portion 28 and have their lower ends connected to the front panel 24 along upstanding fold lines 104 and to the rear panel portion 28 along upstanding fold lines 106.

The left hand set of transverse separators 16 extend between the side panel 26 and the adjacent partition member 22 and slope downwardly into the right and are arranged in vertically stepped relation from front to back. The right hand set of transverse separators 16 in a like manner extend between the right hand partition member 22 and the side panel portion 30 and slope in the same manner as the other transverse separators and are also stepped from front to back in a vertical direction.

Although there has been illustrated only two partition members 22, it is to be understood that there may be a series of such partition members, and that between each pair of adjacent partition members there will be a set of the transverse separators 16 which slope from left to right downwardly and are stepped vertically from front to rear.

As is best shown in FIG. 7, the arrangement of the partition members 22 and the transverse separators 16 define rectangular openings into which packages, containers, bottles, etc. to be displayed and sold may be readily seated.

Figure 8:
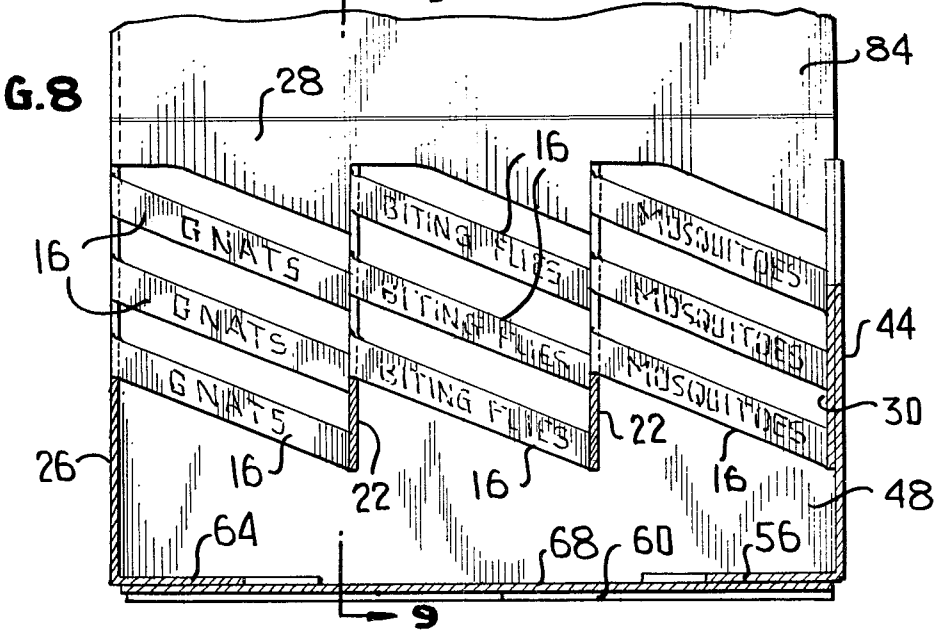
FIG. 8 is a fragmentary vertical sectional view taken generally along the line 8—8 of FIG. 7 and shows the specific arrangement of the partition members and the transverse separators.

Further, as is shown in FIG. 8, suitable identifying indicia may be applied to the transverse separators 16 for identifying the product stored in the associated compartment.

Although only a preferred embodiment of the invention has been specifically illustrated and described here, it is to be understood that minor variations may be made in the display carton in general and the cellular separator arrangement in particular without departing from the spirit and scope of the invention as defined by the appended claims.

I claim:

1. A display carton having an integral panel thereof cut and folded to define a one piece cellular separator arrangement comprising an upstanding front panel, an upstanding upper rear panel portion, a set of fore and aft like upstanding partition members directly integrally connected to said front panel and said upper rear panel portion and sloping upwardly from said front panel at the same elevation to said rear panel portion, an upstanding side panel extending forwardly from one end of said rear panel portion to one end of said front panel, and an upstanding side panel portion extending forwardly from the other end of said rear panel portion to a position adjacent the other end of said front panel; and a first plurality of upstanding transverse separators extending between said side panel and an adjacent one of said partition members, a second plurality of upstanding transverse separators extending between adjacent ones of said partition members, and a third plurality of upstanding transverse separators extending between said side panel portion and an adjacent one of said partition members.

2. A display carton according to claim 1 wherein each of said partition members is vertically disposed, a first set of said transverse separators is connected to a lower edge portion of each of said partition members, and a second set of said transverse separators is connected to an upper edge portion of each of said partition members.

3. A display carton according to claim 2 wherein said transverse separators slope downwardly generally from said side panel towards said side panel portion.

4. A display carton according to claim 2 wherein said side panel has a stepped upper edge, said partition members have stepped upper and lower edges, and said side panel portion has a stepped lower edge.

5. A display carton according to claim 2 wherein said side panel has a stepped upper edge, said partition members have stepped upper and lower edges, and said side panel portion has a stepped lower edge, and all of said transverse separators are formed to seat in an adjacent respective stepped edge when said panels, said panel portions, said partition members and said transverse separators are folded flat.

6. A display carton according to claim 2 wherein said side panel has a stepped upper edge, said partition members have stepped upper and lower edges, and said side panel portion has a stepped lower edge, all of said stepped upper edges being transversely vertically aligned, and all of said stepped lower edges being transversely vertically aligned.

7. A display carton according to claim 2 wherein said side panel has a stepped upper edge, said partition members have stepped upper and lower edges, and said side panel portion has a stepped lower edge, and all of said transverse separators are connected to said stepped edges along vertical fold lines.

8. A display carton according to claim 2 wherein said front panel has a stepped upper edge and said rear panel portion has a stepped lower edge, and said partition members being connected to said stepped edges along vertical fold lines.

9. A display carton according to claim 1 together with a second side panel connected to said front panel at said other end thereof and to a front edge of said side panel portion.

10. A display carton according to claim 9 together with a full width rear panel connected to a rear edge of said side panel and to said one edge of said rear panel portion.

11. A display carton according to claim 10 together with bottom forming flaps carried by lower edges of said side panels, said front panel and said rear panel.

12. A display carton according to claim 9 together with a full width rear panel connected to a rear edge of said side panel and to said one edge of said rear panel portion, and a flap connecting said rear panel to a rear part of said second side panel.

13. A display carton according to claim 1 together with a second side panel connected to said front panel at said other end thereof and to a front edge of said side panel portion, said second side panel being disposed outwardly of said side panel portion.

14. A display carton according to claim 1 together with a full width rear panel connected to a rear edge of said side panel and to said one edge of said rear panel portion.

15. A blank for forming a cellular separator arrangement, said blank including an elongated generally rectangular panel, plural sets of overlapping sloping cut lines in said panel, all of said cut lines of each set being parallel with adjacent pairs of said cut lines each defining a separator, a transverse fold line at the end of each separator, said plural sets of overlapping cut lines defining at one end of said blank panel a side panel, at the other end of said blank panel a side panel portion, and intermediate partition members, longitudinal cut lines in said panel at first ends of said side panel portion and said partition members defining a front panel, and other longitudinal cut lines in said panel at second ends of said partition members and said side panel defining a rear panel portion.

16. A blank according to claim 15 wherein there are panels connected to said blank panel along transverse fold lines and defining a second side panel and a full width rear panel.

17. A blank according to claim 16 wherein each of said side panels, said front panel and said rear panel carry a bottom panel.

* * * * *